United States Patent [19]

Louderback et al.

[11] 4,142,985

[45] Mar. 6, 1979

[54] METHOD OF FORMULATING A GERMICIDAL SOAP

[76] Inventors: Allan L. Louderback, 9661 Longden Ave., Temple City, Calif. 91780; Robert A. Huddy, 1044 Balboa Dr., Arcadia, Calif. 91006

[21] Appl. No.: 871,357

[22] Filed: Jan. 23, 1978

[51] Int. Cl.[2] ..... C11D 3/48

[52] U.S. Cl. ..... 252/106; 424/249; 424/361

[58] Field of Search ..... 252/106, 107; 424/244, 424/249, 330

[56] References Cited

U.S. PATENT DOCUMENTS

| | | | |
|---|---|---|---|
| 2,904,468 | 9/1959 | Davis et al. | 252/106 X |
| 3,326,808 | 6/1967 | Noseworthy | 252/106 |
| 3,597,360 | 8/1971 | Collins et al. | 252/106 |
| 3,714,075 | 1/1973 | Johnson | 252/545 |
| 3,770,373 | 11/1973 | Schwartz | 8/142 |
| 4,077,911 | 3/1978 | Okumura et al. | 252/550 |

FOREIGN PATENT DOCUMENTS

| | | |
|---|---|---|
| 1587352 | 2/1970 | France. |
| 1101830 | 1/1968 | United Kingdom. |

OTHER PUBLICATIONS

Dow, "Problems Keeping Cosmetics Fresh?–Try Dowicil 200", Dow Chemical Co., 1970, pp. 1–5.

Condensed Chemical Dictionary, Reinhold Publishing Co., N. Y., 1950, 4th Ed., p. 503.

*Primary Examiner*—P.E. Willis, Jr.

*Attorney, Agent, or Firm*—Fred N. Schwend

[57] ABSTRACT

A surgical scrub soap in liquid form that kills both *Staphyllococcus aureus* and *Pseudomonas aerogenosa* bacteria. The soap is nontoxic to humans and animals, nonirritating to the skin and biodegradable, and it rinses clean without leaving a residue. The soap is a formulation of ingredients, including a minor amount of pectin as a thickening agent, a minor amount of methanol or ethanol, glycerol, propylene glycol, a trace of a suitable dye, a minor amount of the disodium salt of ethylene diamine tetraacetic acid as a pH adjuster, 0.09% by weight of the cis isomer of 1-(3-chloroallyl)-3,5,7-triaza-1-azoniaadamantane chloride as a germicide, dodecylbenzene sulfonate of triethylamine as a biodegradable detergent, a trace amount of a suitable fragrance and 55.85% by weight of deionized water. The formulation is prepared at ordinary room temperature, without the addition of any heat, in accordance with the following procedure. The pectin and alcohol are stirred for five minutes to solubilize the pectin. The glycerol and propylene glycol are then added to the pectin-alcohol solution, and the resulting mixture is stirred for ten minutes. The deionized water, dye, pH adjusting agent and germicide are mixed separately, and then added to the mixture containing the pectin. The resulting batch is stirred well, then the fragrance and detergent are added with continued stirring of the batch. After twenty minutes of stirring, the solution is well homogenized and ready for packaging and use.

5 Claims, No Drawings

METHOD OF FORMULATING A GERMICIDAL SOAP

BACKGROUND OF THE INVENTION

This invention relates generally to liquid soap preparations, and more particularly to such a preparation suitable for use as a surgical scrub soap.

As surgeons, and others in the medical profession, are aware, two types of bacteria, namely, *Staphyllococcus aureus* (ordinarily referred to as staph) and *Pseudomonas aerogenosa,* are present in all hospitals and potentially harmful to hospital patients, particularly when such patients are undergoing surgery. To minimize the threat of these bacteria insofar as humanly possible, surgeons carefully "scrub up" prior to operating on a patient, using a germicidal soap to kill harmful bacteria on their hands and forearms. Not many germicidal agents suitable for use in appropriate quantities in scrub soaps, however, kill both staph and pseudomonas bacteria, which means that conventional scrub soaps offer less than a complete solution to the problem. While silver nitrate is known to be a standard germ-killing agent, its use for that purpose in surgical scrub soaps has not proven very satisfactory. For one thing, where silver nitrate is present in nontoxic levels in such soaps, it has been found completely ineffective to kill bacteria. Furthermore, silver nitrate, because of its high density, settles out of liquid suspensions in relatively short periods (something like a week, on the average), so is completely unsatisfactory for use in liquid scrub soaps.

Hexachlorophene, another known germicidal agent is impermissible as a scrub soap ingredient in this country, having been banned for use (without a prescription) by the U.S. Food and Drug Administration because of possibe carcinogenicity.

For the reasons given above, and others, no completely versatile surgical scrub soap capable of killing both staph and pseudomonas bacteria, while remaining nontoxic to humans and animals, has yet, to our knowledge, been provided. Moreover, scrub soaps heretofore available to surgeons have often been irritating to the skin (allergenic), nonbiodegradable, and of such type as to leave a residue that does not rinse clean, or to have possessed one or two of those three drawbacks.

SUMMARY OF THE INVENTION

We have now, by means of the present invention, succeeded in providing a liquid surgical scrub soap that is nontoxic to humans and animals, kills both staph and pseudomonas bacteria, is nonirritating to the skin (nonallergenic), biodegradable, rinses freely without leaving a residue and can be formulated at relatively low cost from readily available materials requiring no prescription. Furthermore, our novel scrub soap makes an excellent shampoo which does not burn the eyes like ordinary shampoos. Our unique formulation can be prepared simply and easily at room temperature, to thereby avoid the necessity of adding heat, as is normally required in soap making processes (which typically include hot and cold mixing phases).

Our remarkably effective scrub soap formulation came to light as a result of our discovery, after four years of experimentation, that a minute quantity of the cis isomer of 1-(3-chloroallyl)-3, 5, 7-triaza-1-azoniaadamantane chloride in such a formulation successfully kills all bacteria, including staph and pseudomonas bacteria, without toxicity to humans or animals. More specifically, we have found that only 0.09% by weight of that agent in a scrub soap, an amount so small as to be completely nontoxic, is totally effective as a germicidal agent therein. The material is a product of Dow Chemical Co. available on the market under the proprietary name "Dowicil", so will hereinafter be referred to by that name. It is to be understood, however, that our formulation is not limited to the inclusion of that particular product, but only to its generic counterpart.

Our liquid soap includes, in addition to an extremely small amount of Dowicil as a germicidal agent, a unique combination of ingredients carefully chosen during a long period of experimentation to provide a scrub soap having the germ-killing power disclosed herein, minus the above-noted disadvantages of conventional scrub soaps. More specifically, our scrub soap formulation contains dodecylbenzene sulfonate of triethylamine (more commonly known as TEA) in substantial quantity (preferably 20.11%) as a detergent or surfactant, which material is biodegradable to thereby provide a scrub soap free of the harmful contaminating effect that many conventional detergents have on the environment. Our formulation contains pectin as a thickening agent, instead of the more traditional methyl cellulose employed in many soaps. To adjust the pH of the scrub soap, we employ the disodium salt of ethylene diamine tetracetic acid (hereinafter called EDTA) in small quantity, which material also serves as a chelating agent to bind calcium and magnesium ions in the water. Most soap formulators employ sodium hydroxide or citric acid, agents which tend to irritate the skin, for pH adjustment. Additionally, our formulation contains methanol and/or ethanol, in small amounts, for a reason hereinafter explained, glycerol (to prevent drying of the skin), propylene glycol (as a preservative and disinfectant) and a major amount of deionized water. Preferably, but not necessarily, it also contains a small quantity of a suitable dye and a small amount of suitable fragrance as, for example, lime or lemon fragrance.

While the experimental selection of the right combination of ingredients for our scrub soap constituted an important aspect of our invention, this does not tell the whole story. It was necessary not only to find those ingredients, but to arrive at a method of combining them in such a way as to yield a liquid scrub soap of suitable character for our purpose. The final result of our efforts was a cold mixing process involving a special order of addition of the various ingredients to produce a stable, homogenized mixture with the superior qualities disclosed herein. Our process thus differs from normal soap making procedures in that the latter involve both hot and cold phases of manufacture. Our special order of addition of the various ingredients of our scrub soap is necessary because of certain solubility, and other, characteristics of those ingredients that would interfere with proper mixture thereof if all were dumped together at the same time, or combined in the wrong order of addition. For example, when pectin is added directly to water, it will not go into solution to form a homogeneous mixture. In our method of formulation this difficulty is overcome by first mixing the pectin with alcohol (methanol, ethanol or a mixture thereof) to solublize the pectin, and then stirring the glycerol and propylene glycol into the pectin-alcohol mixture. After the propylene glycol is mixed with the pectin, the various other ingredients of our formulation are combined therewith in accordance with the procedure hereinafter described to yield, as a final product, a liquid soap of biodegradable character, and possessed of the other desirable properties mentioned above. Among these is an ability to rinse clean without leaving a residue on the skin. We believe our scrub soap rinses easily, in spite of the insolubility of pectin in water and well-known viscous nature of glycerol and propylene glycol, because our unique method of formulation, and relative proportions of the involved ingredients, result in a dilute mixture of pectin, glycerol and propylene glycol that is well homogenized to permit it to be washed readily from the hands, or other skin surfaces. A particular advantage of our novel scrub soap, not specifically mentioned above, is that the soap can be used with complete safety because there is no absorption of germicide therefrom through the skin.

As previously indicated, our novel formulation makes an excellent shampoo, so mild that it does not even burn the eyes as do conventional shampoos. The soap has been found to be nontoxic to either humans or animals.

It is thus a principal object of the present invention to provide a relatively inexpensive liquid soap, ideally suited for use as a surgical scrub soap, that effectively kills both staph and pseudomonas (as well as other) bacteria, is nontoxic to humans and nonallergenic, and which rinses clean without leaving a residue behind.

Another object of the invention is to provide such a soap of biodegradable character.

Another object of the invention is to provide a method of preparing such a soap entirely without the addition of any heat.

Other objects, features and advantages of the invention will become apparent in the light of subsequent disclosures herein.

DESCRIPTION OF PREFERRED EMBODIMENT

The following example illustrates our preferred method of making a surgical scrub soap in accordance with the present invention. It should, of course, be understood that this example is included for illustrative purposes only and that the invention is not necessarily limited to the particular combination of materials, conditions, proportions, etc., set forth therein.

EXAMPLE

A quantity of pectin sufficient to comprise 1.86% by weight of an eighty gallon batch of liquid soap in accordance with this invention was weighed out and mixed with a quantity of methanol equivalent to 1.48% by weight of the batch. The mixing was accomplished with a propeller mixer, and continued for five minutes. Then, an amount of glycerol equivalent to 16.55% by weight of the 80 gallon batch was added to the alcohol-pectin mixture with continued stirring, after which an amount of propylene glycol equal to 3.44% by weight of the 80 gallon batch was added. The mixing was continued for ten minutes.

In a separate vessel, an amount of deionized water equal to 55.85% by weight of the overall soap mixture; an amount of 6% aqueous solution of Tartrazine (FD & C yellow #5) dye equivalent to 0.09% by weight of the soap batch; an amount of the disodium salt of EDTA equivalent to 0.46% by weight of the total soap batch; and an amount of Dowicil equivalent to 0.09% by weight of the soap batch were combined and mixed. The resulting solution was then added to the first mixture with stirring. When the overall mixture was well stirred, the stirring was continued and an amount of fragrance equivalent to 0.03% by weight of the finished batch and an amount of TEA dodecylbenzene sulfonate equivalent to 20.11% by weight of said batch were stirred into the mix. The mixing was continued for twenty minutes to yield the final soap product. The product was a well homogenized liquid formulation suitable as a surgical scrub soap capable of killing staph and psedomonas bacteria, of biodegradable character, and possessed of the other beneficial properties (nonallergenicity, easy rinsibility, etc.) disclosed above.

As previously indicated, ethanol could be substituted for the methanol in the above example, or a mixture of methanol and ethanol could be employed in lieu thereof (of methanol alone), if desired. Also as previously indicated, our novel scrub soap formulation is not limited to the inclusion of Tartrazine dye, or even to any dye at all. Where a dye is employed, however, a yellow one is preferred, although, as will now be evident, any suitable dye of any other color could be used in lieu thereof if desired. The same thing is true with respect to the fragrance, the use of any suitable fragrance, or none at all, being within the scope of our invention. For example, lime, lemon, lemon-lime, rose, or any other, fragrance could be employed for our purpose as desired. The remaining ingredients of our scrub soap formulation are critical, and must be present in the amounts specified in the above example, except that the amount of each can vary ±10% in accordance with permissible U.S. Food and Drug Administration tolerances. The stirring of the ingredients in the example are carried out at relatively slow speeds (preferably from about 50 to about 100 r.p.m.) to minimize sudsing. Any other type of suitable mixer, such as, for example, a paddle mixer, can be substituted for the above-mentioned propeller mixer, within the scope of our invention. As indicated in the aforesaid example, all mixing operations were carried out at normal ingredient temperatures, no heat being added at any time during the formulation process.

Although our novel process has been herein described in relatively narrow terms of reference to one example, it will be appreciated that the process, and resulting product, are not limited to the specifics of that example but only insofar as dictated by the language of the following claims.

We claim:

1. A method of formulating a liquid composition particularly suitable for use as a surgical scrub soap, which composition kills bacteria including Staphylococcus aureus and Pseudomonas aerogenosa bacteria, is nontoxic and nonirritating to the skin, rinses clean without leaving a residue, and is biodegradable, said composition comprising an intimate mixture of 0.081 to 0.099 parts by weight of the cis isomer of 1-(3-chloroallyl)-3,5,7-triaza-1-azoniaadamantane chloride; 18.10 to 22.12 parts by weight of dodecylbenzene sulfonate of triethylamine; 1.674 to 2.046 parts by weight of pectin; 1.332 to 1.628 parts by weight of alcohol selected from the group consisting of methanol, ethanol and mixtures thereof; 14.895 to 18.205 parts by weight of glycerol; 3.096 to 3.784 parts by weight of propylene glycol; 0.414 to 0.506 parts by weight of the disodium salt of ethylene diamine tetraacetic acid; and 50.265 to 61.435 parts by weight of deionized water, comprising the steps of:

mixing well the pectin and alcohol;

mixing the glycerol and propylene glycol with the pectin-alcohol mixture to form a first liquid batch;

separately combining and mixing the deionized water, disodium salt of ethylene diamine tetraacetic acid and cis isomer of 1-(3-chloroallyl)-3,5,7-triaza-1-azoniaadamantane chloride to form a second liquid batch;

mixing well the first and second liquid batches to form a third liquid batch; and mixing the dodecylbenzene sulfonate of triethylamine into said third batch.

2. A method of formulating a liquid composition as defined in claim 1, wherein said composition includes a minor amount of a suitable dye and a minor amount of a suitable fragrance, comprising the steps of:

mixing the dye with the deionized water, disodium salt of ethylene diamine tetraacetic acid and cis isomer of 1-(3-chloroallyl)-3,5,7-triaza-1-azoniaadamantane chloride to form said second liquid batch; and mixing the fragrance and dodecylbenzene sulfonate of triethylamine into said third batch.

3. A method of formulating a liquid composition as defined in claim 2 in which the dye is FD & C yellow #5 dye and is present in an amount equivalent to that resulting from the incorporation of 0.081 to 0.099 parts by weight of a 6% aqueous solution thereof into said intimate mixture, and in which the fragrance is present in an amount equivalent to 0.027 to 0.033 parts by weight of said intimate mixture, comprising the steps of:

mixing the dye with the deionized water, disodium salt of ethylene diamine tetraacetic acid and cis isomer of 1-(3-chloroallyl)-3,5,7-triaza-1-azoniaadamantane chloride to form said second liquid batch; and mixing the fragrance and dodecylbenzene sulfonate of triethylamine into said third batch.

4. A method in accordance with claim 2 in which all steps are carried out without the addition of heat.

5. A method in accordance with claim 4 in which the dodecylbenzene sulfonate of triethylamine is mixed into said third batch with mechanical stirring means operated at relatively slow speed to minimize sudsing.

* * * * *